US005519806A

United States Patent [19]

Nakamura

[11] Patent Number: 5,519,806

[45] Date of Patent: May 21, 1996

[54] SYSTEM FOR SEARCH OF A CODEBOOK IN A SPEECH ENCODER

[75] Inventor: Makio Nakamura, Tokyo, Japan

[73] Assignee: NEC Corporation, Tokyo, Japan

[21] Appl. No.: 166,107

[22] Filed: Dec. 14, 1993

[30] Foreign Application Priority Data

Dec. 15, 1992 [JP] Japan ..... 4-354260

[51] Int. Cl.[6] ..... G10L 3/02; G10L 9/00

[52] U.S. Cl. ..... 395/2.27; 395/2.28; 395/2.32

[58] Field of Search ..... 381/36, 40, 49; 395/2, 2.27, 2.28, 2.31, 2.32

[56] References Cited

U.S. PATENT DOCUMENTS

| | | | |
|---|---|---|---|
| 4,817,157 | 3/1989 | Gerson | 381/40 |
| 4,896,361 | 1/1990 | Gerson | 381/49 |
| 5,187,745 | 2/1993 | Yip et al. | 381/36 |

FOREIGN PATENT DOCUMENTS

| | | | |
|---|---|---|---|
| EP-A0497479 | 8/1992 | European Pat. Off. | H03M 7/30 |
| EP-A0501420 | 9/1992 | European Pat. Off. | G10L 9/16 |
| EP-A0516439 | 12/1992 | European Pat. Off. | G10L 7/04 |

OTHER PUBLICATIONS

M. Schroeder et al., "Code-Excited Linear Prediction (CELP): High-Quality Speech at Very Low Bit Rates", ICASSP, vol. 3, Mar. 1985, pp. 937–940.

*Primary Examiner*—Allen R. MacDonald
*Assistant Examiner*—Richemond Dorvil
*Attorney, Agent, or Firm*—Sughrue, Mion, Zinn, Macpeak & Seas

[57] ABSTRACT

A speech encoder synthesizes an excitation sound source in accordance with the linear coupling of at least two predetermined basis vectors. In realizing the codebook search by using signal processing LSIs, the ordination of the first cross correlation $R_m$ between an input speech signal p(n) and plural reproduced signals obtained by using plural basis vectors is computed, and the ordination of the second cross correlation $D_{mj}$ of the plural reproduced signals qm(n) is computed. These ordinations are arranged to be one ordination $Rd_{mj}$. By using the ordination $Rd_{mj}$, all possible combinations of the third and fourth cross correlation calculations are carried out to provide a most optimum codebook.

2 Claims, 6 Drawing Sheets

SYSTEM FOR SEARCH OF A CODEBOOK IN A SPEECH ENCODER

FIELD OF THE INVENTION

This invention relates to a system for search of a codebook in a speech encoder, and more particularly to, a codebook search system in a speech encoder in which an excitation sound source is synthesized in accordance with the linear coupling of at least two basis vectors.

BACKGROUND OF THE INVENTION

Conventionally, various speech encoders applicable to digital mobile communication systems have been proposed and practically used in, for instance, the car industry. A CELP (Code Excited LPC coding) process is typically used ill the systems.

The CELP process is a speech encoding process in which an excitation signal of speech is generated by a codebook, wherein short term parameters representing spectrum characteristics of a speech signal are sampled from the speech signal in each frame of, for instance, 20 ms, and long term parameters representing pitch correlation with the past speech signal are sampled from the presently supplied speech signal in each subframe of, for instance, 5 ms. Thus, long and short term predictions are carried out to obtain long and short term excitation signals by the pitch and spectrum parameters, so that a synthesized speech signal is generated by adding the long term excitation signal to a signal selected from a codebook storing predetermined kinds of noise signals (random signals), and then adding the short term excitation signal to the signal thus obtained in the above addition of the long term excitation signal to the codebook selected signal. This synthesized speech signal is compared with an input speech signal in a subtractor to generate an error signal, so that one kind of noise signal is selected from the codebook to minimize the error signal. This CELP process is described in a report titled "Code-excited linear prediction: High quality speech at very low bit rates" by M. Schroeder and B. Atal on pages 937 to 940 "ICASSP, Vol. 3, March 1985".

In this CELP process, a VSELP (Vector Sum Excited Linear Predication) process has been proposed. Between the both processes there is a difference in that a synthesized signal is generated in the VSELP process by the linear coupling (code summation) of more than two predetermined basis vectors, so that the synthesizing process steps are largely decreased in number to improve error tolerance as compared to the CELP process.

In the VSELP process, the linear coupling of optimum basis vectors is transmitted from a transmitting side to a receiving side by using parameters defined codewords. For this purpose, optimum codewords must be searched on the transmitting side. This search is defined "codebook search". A conventional codebook search system is described in the U.S. Pat. No. 4,817,157, as explained later.

However, the conventional codebook search system has a disadvantage in that the number of functions to be used for computing cross correlations is large, resulting in difficulty of addressing and an increase in amount of calculations necessary for realizing a hardware system using signal processing LSIs (DPSs).

SUMMARY OF THE INVENTION

Accordingly, it is an object of the invention to provide a system for search of a codebook in a speech encoder in which the number of functions to be used for computing cross correlations in decreased.

It is a further object of the invention to provide a system for search of a codebook in a speech encoder in which the addressing is facilitated and the calculation amount is decreased, when a codebook search system is realized by signal processing LSIs.

According to the invention, a system for search of a codebook in a speech encoder, comprises:

means for computing an ordination of a first cross correlation $R_m$ between an input speech signal p(n) and plural reproduced signals qm(n) obtained by using plural basis vectors;

means for computing an ordination of a second cross correlation $D_{mj}$ of the plural reproduced signals qm(n);

means for providing one ordination $RD_{mj}$ obtained from the first and second cross correlation $R_m$ and $D_{mj}$; and means for executing a calculation of determining a most optimum codeword by using the ordination $RD_{mj}$.

BRIEF DESCRIPTION OF THE DRAWINGS

The invention will be explained in more detailed in conjunction with the appended drawings, wherein.

DESCRIPTION OF THE PREFERRED EMBODIMENTS

Figure 1:
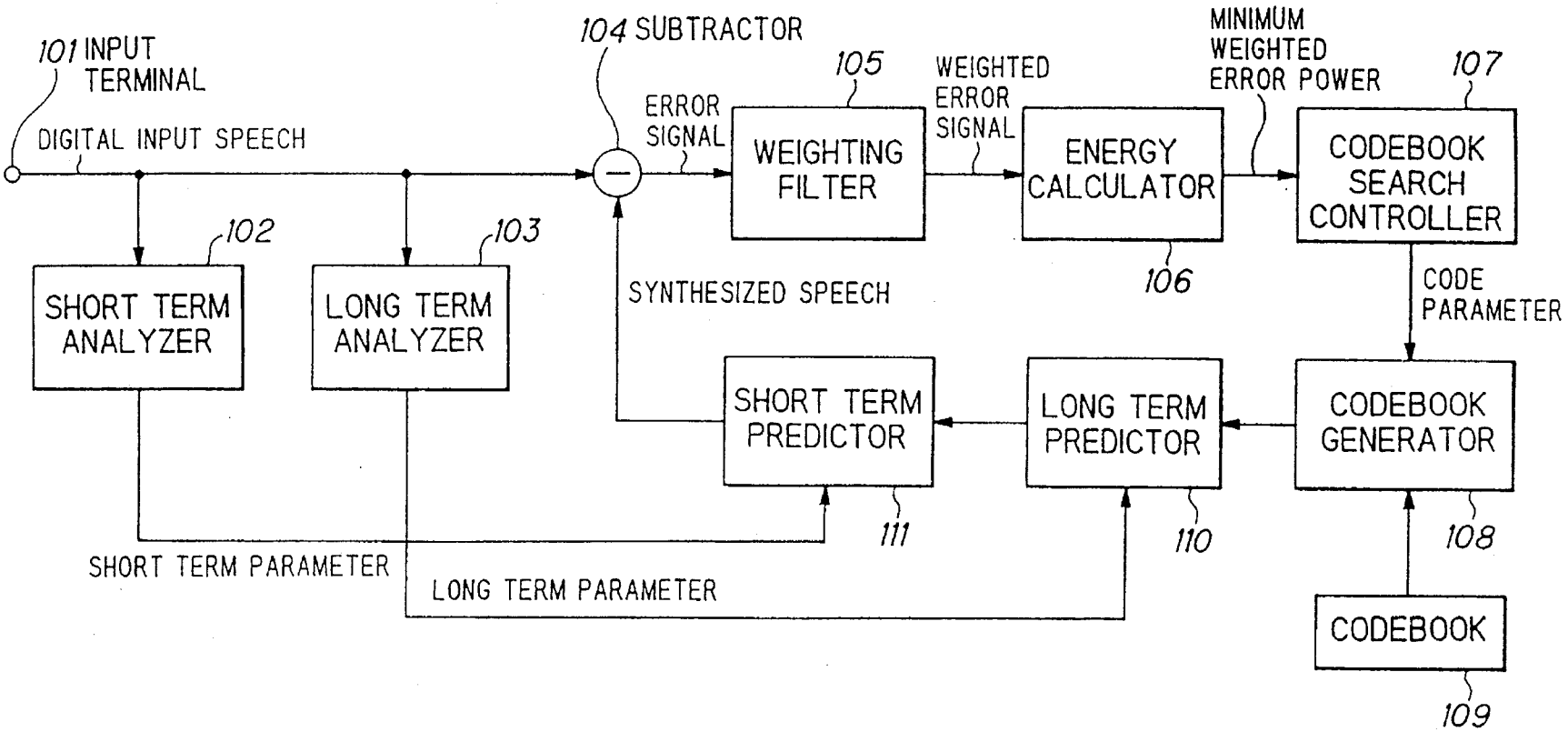
FIG. 1 PRIOR ART
FIG. 1 is a block diagram showing a conventional codebook search system.

Before explaining a system for search of a codebook in a speech encoder in the preferred embodiment, the aforementioned conventional codebook search system will be explained in FIG. 1.

The conventional codebook search system comprises a short term analyzer 102 for sampling a digital speech signal supplied to an input terminal 101 in each frame of 20 ms to provide short term parameters representing spectrum characteristics, a long term analyzer 103 for sampling the digital speech signal in each subframe of 5 ms to provide long term parameters representing pitch correlations of the presently supplied speech signal with the past speech signal, a subtractor 104 for generating an error signal between the digital speech signal and a synthesized speech signal to be explained later, a weighting filter 105 for providing a weighted error signal by receiving the error signal, an energy calculator 106 for providing a minimum weighted error power signal by receiving the weighted error signal, a codebook search controller 107 for generating code parameters in accordance with the minimum weighted error power signal, a codebook generator 108 for selecting a codeword from predetermined codewords by receiving the code parameters, a codebook 109 for storing the predetermined codewords, a long term predictor 110 for predicting a long term excitation signal by receiving the long term parameters and adding the excitation signal and the selected codeword, and a short term predictor 111 for supplying the synthesized speech signal to the subtractor 104 by predicting a short term excitation signal in accordance with the short term parameter, and adding the short term excitation to a signal supplied from the long term predictor 110.

In operation, optimum codewords are selected from the codebook 109 by minimizing the error signals in the subtractor 104 (details are explained in the U.S. Pat. No. 4,817,157).

Figure 2A:
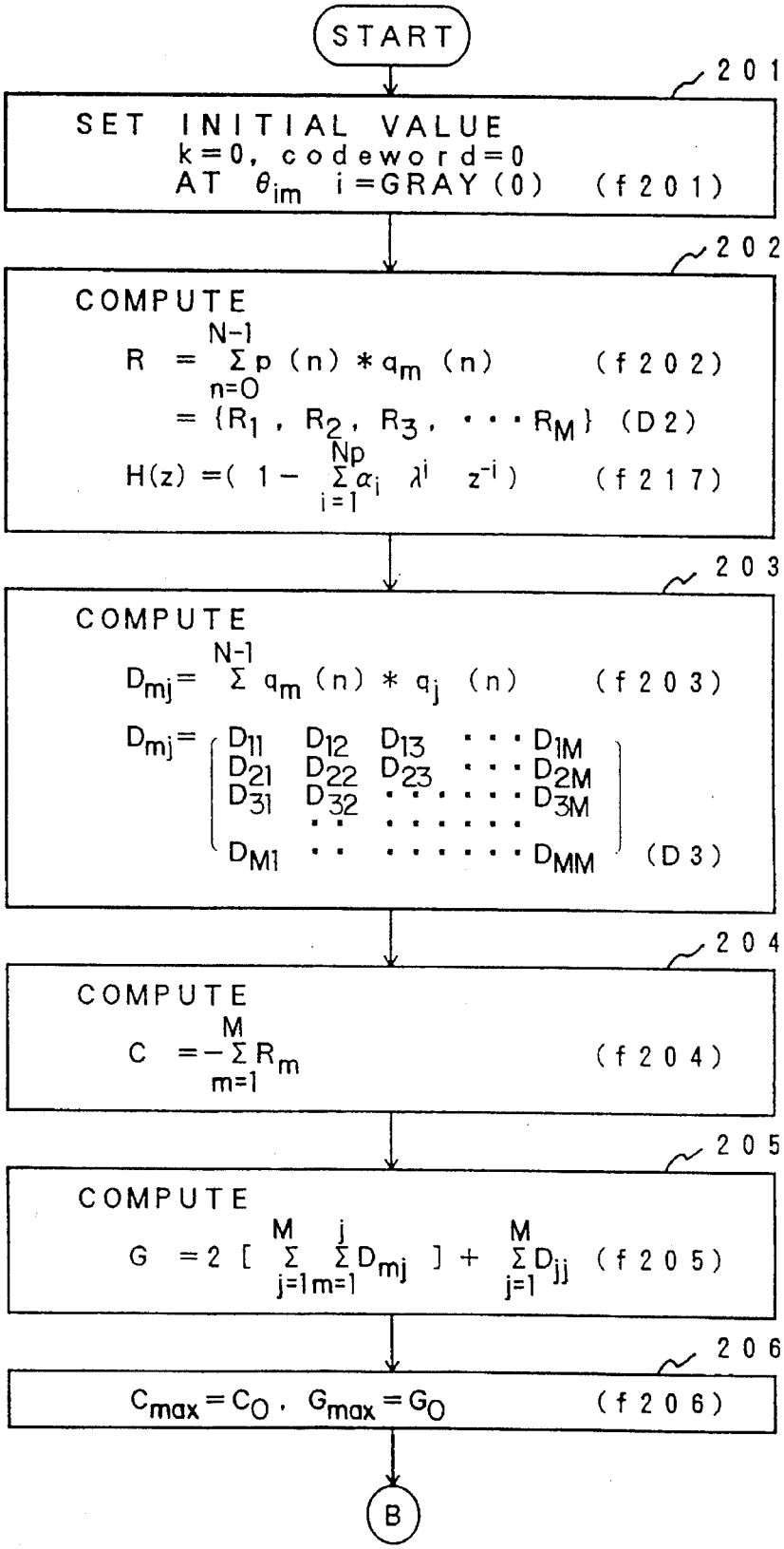
FIG.2A PRIOR ART
FIG. 2A an 2B are flow charts showing operation in the Conventional codebook search system.
Figure 2B:
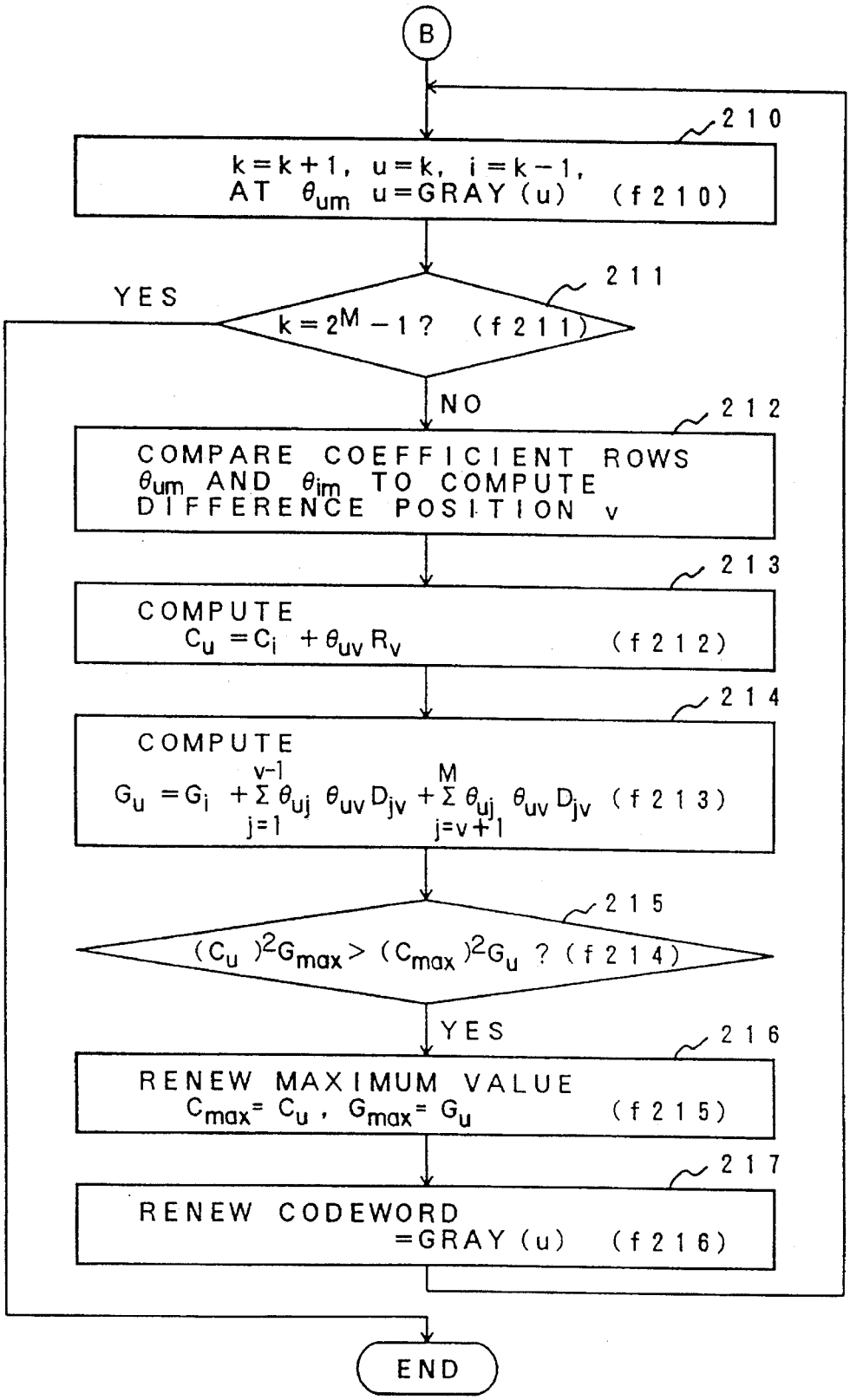
FIG.2B PRIOR ART

In the codebook search system as explained in FIG. 1, a codebook search process as shown in FIGS. 2A and 2B is carried out.

In FIG. 2A, a variable k, a codeword, and $\theta_{im}$ are initialized at step 201, where $\theta_{im}$ is a coefficient row representing the combination of coefficients (+1 or −1) of linear coupling for a M-order basis vector, and the relation with a codeword is defined below.

When mth bit of a codeword i is 1, $\theta_{im}=1$, and when it is 0, $\theta_{im}=-1$ At this step, GRAY (i) is a function for Gray-code, and GRAY (i-1) and GRAY (i) are defined to be under this relation in which data is inverted by one bit, where the data is of a binary code. Here, $\theta_{im}$ is assumed below.

concerning $\theta_{im}$, i=GRAY (i)

At this step, the initialization is done to be "i=GRAY (0)" at $\theta_{im}$ as indicated by the equation "f201".

At step 202, the first cross correlation $R_m$ ($1 \leqq m \leqq M$, M is the order of a basis vector) using signals p(n) and qm(n) is computed by the equation "f202", and the ordination $R_m$ represented by D2 is obtained.

Here, p(n) is a signal obtained by subtracting a zero input response of a filter having a property represented by the equation "f217" from an input speech signal weighted by the spectrum parameter. In this equation "f217", $N_p$ is the order of the spectrum parameter, $\alpha_i$ the spectrum parameter, and $\lambda^i$ is a weighting coefficient. On the other hand, qm(n) is a signal obtained by subtracting a reproduced signal in the form of an excitation signal obtained in accordance with the long term prediction from a reproduced signal of Mth order basis vector.

At step 203, the second cross correlation ($1 \leqq m \leqq j \leqq M$) using the signal qm(n) and a signal qi(n) is computed by the equation "f203", and the ordination $D_{mj}$ represented by D3 is obtained.

At step 204, a value at $\theta_{om}$, of correlation $C_u$ using $\theta_{im}$ and $R_m$, that is, $C_o$ is computed by the equation "f204".

At step 205, a value, at $\theta_{om}$, of the fourth cross correlation comprising a cross correlation comprising a cross correlation of $\theta_{im}$, $\theta_{ij}$ and $D_{mj}$ ($1 \leqq j \leqq N$, $1 \leqq m \leqq j$), that is, $G_o$ is computed by the equation "f205".

At step 206, these values are assumed to be the maximum value $C_{max}$ for $G_u$, and the maximum value $G_{max}$ for $G_u$, and the process is continued to steps as shown in FIG. 2B.

At step 210, the variable k is incremented by one, and variables u and i are set to be k and k−1, respectively. In the equation "f210", "u=GRAY (u)" is set at $\theta_{um}$, and following steps 212 to 217 and the step 210 are repeated until the equation "f211" becomes truth at step 211.

At step 212, the coefficient row $\theta_{um}$ of the present time and the coefficient row $\theta_{im}$ of the former time are compared to provide the difference position v. The value v is one value of 1 to M.

At step 213, the third cross correlation $C_u$ of the present time is effectively computed by adding a value determined by $\theta_{uv}$ and $R_v$ to the third cross correlation $C_i$ of the former time, as represented by the equation "f212".

At step 214, the fourth cross correlation $G_u$ of the present time is effectively computed by adding a value determined by $\theta_{uj}$, $\theta_{uv}$, $D_{jv}$ and $D_{vj}$ to the fourth cross correlation $G_i$ of the former time, as represented by the equation "f213".

At step 215, a codeword which is now checked is examined to determine whether it is more optimum than codewords selected so far by using the presently computed $C_u$ and $G_u$, and the maximum values $C_{max}$ and $G_{max}$ among the values $C_u$ and $G_u$ computed so far, and, when the equation "f214" is false, that is, a codeword which is more optimum than the codeword of the present time has been already obtained, the process is returned to the step 210, at which a next codeword is examined.

At step 216 and 217, when the equation "f214" is determined to be truth at the step 214, that is, the codeword of the present time is determined to be more appropriate than the codewords computed so far, the processes are executed, wherein the step 216 renews the maximum values $C_{max}$ and $G_{max}$ with the values $C_u$ and $G_u$ of the present time by the equation "f215", and the step 217 renews the codeword with the most optimum codeword in accordance with GRAY (u) by the equation "f216".

As explained above, the third and fourth cross correlations are effectively computed at the steps 213 and 214 by using the formerly computed third and fourth cross correlations. However, five kinds of functions must be used in the equations "f212" and "f213" at the steps 213 and 214. Therefore, the aforementioned disadvantages are observed in the conventional codebook search system.

Next, a codebook search process in a system for search of a codebook in a speech encoder in the preferred embodiment will be explained.

Figure 3:
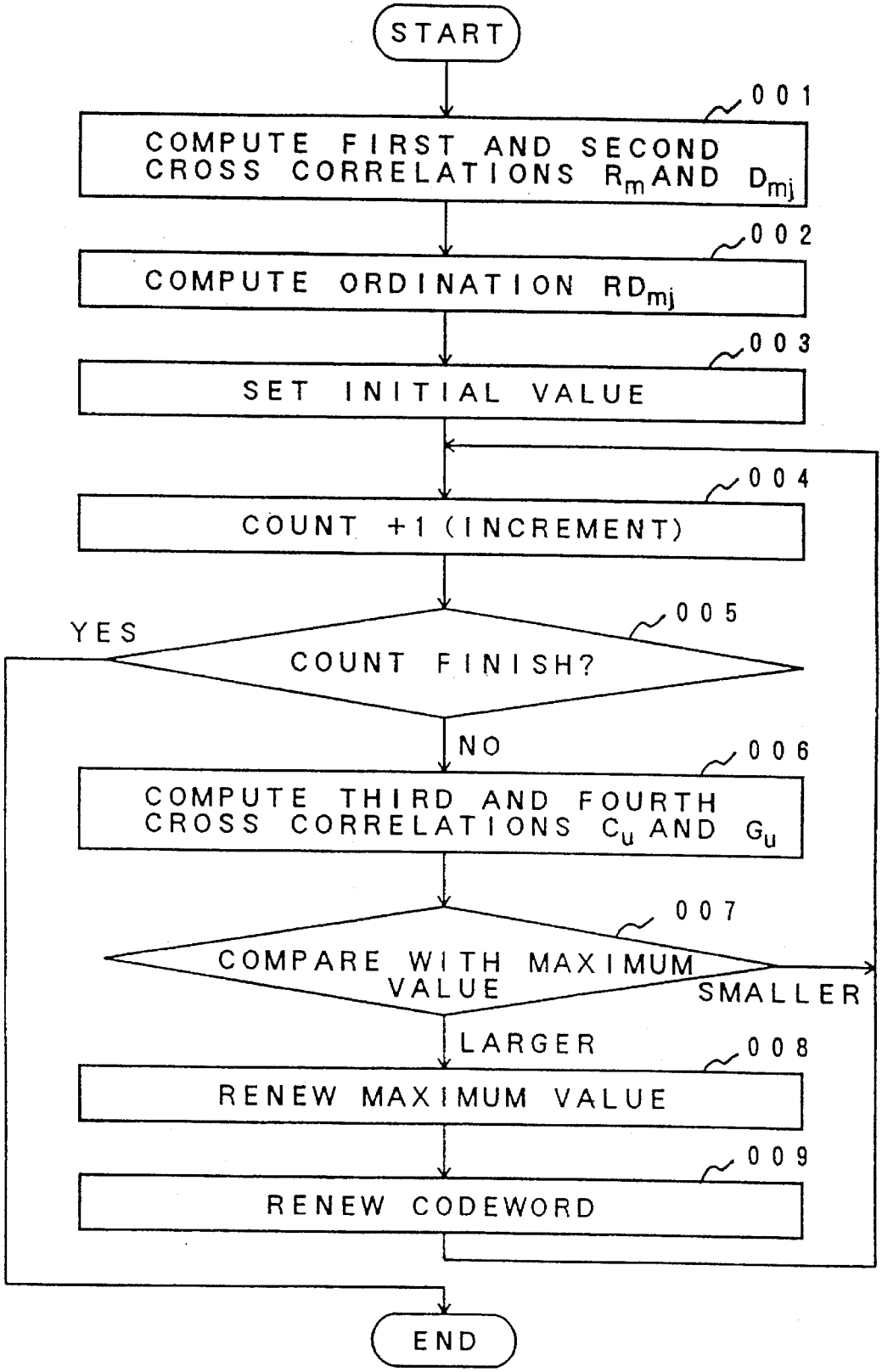
FIG. 3, FIG. 4 and 4B are flow charts showing operation in a system for search of a codebook in a speech encoder in a preferred embodiment according to the invention.

FIG. 3 shows a summarized flow chart by which the VSELP speech encoding process is carried out by DSP.

At step 001, the first and second cross correlations $R_m$ and $D_{mj}$ are computed in the same manner as in the conventional codebook search process.

At step 002, the first and second cross correlations $R_m$ and $D_{mj}$ are arranged in one ordination $RD_{mj}$.

At step 003, initial values for following calculations such as initial maximum values for the third and fourth cross correlations $C_u$ and $G_u$, etc. are set.

At step 004, a counter for prescribing a codeword to be examined is incremented by one.

At step 005, steps 006 to 009 are repeated until it is determined that the count is finished, wherein the third and fourth cross correlations $C_u$ and $G_u$ are computed to result in the decrease of functions to be used by one in number, because the first and second cross correlations $R_m$ and $D_{mj}$ are arranged in on ordination $D_{mj}$ at the step 002.

Figure 4A:
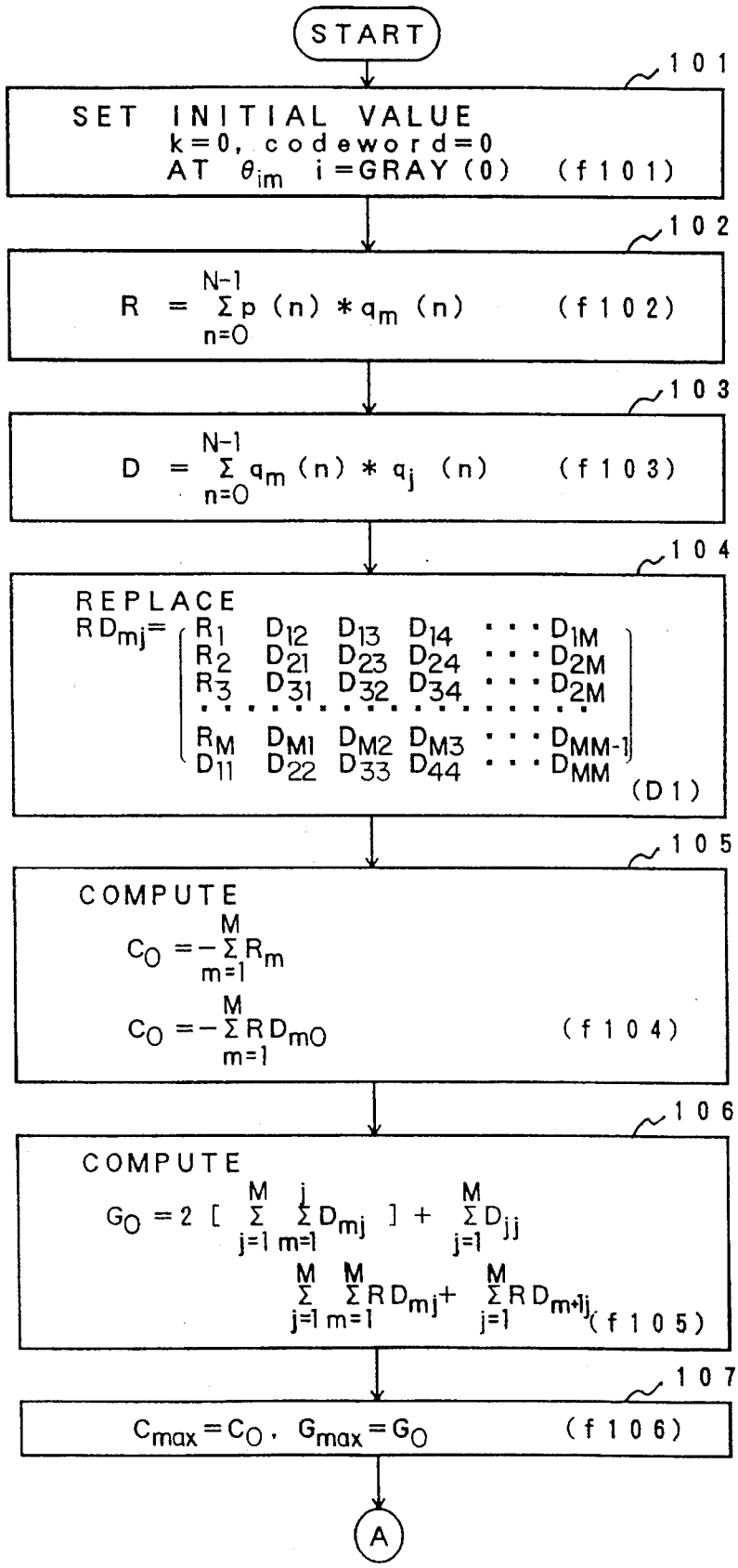
Figure 4B:
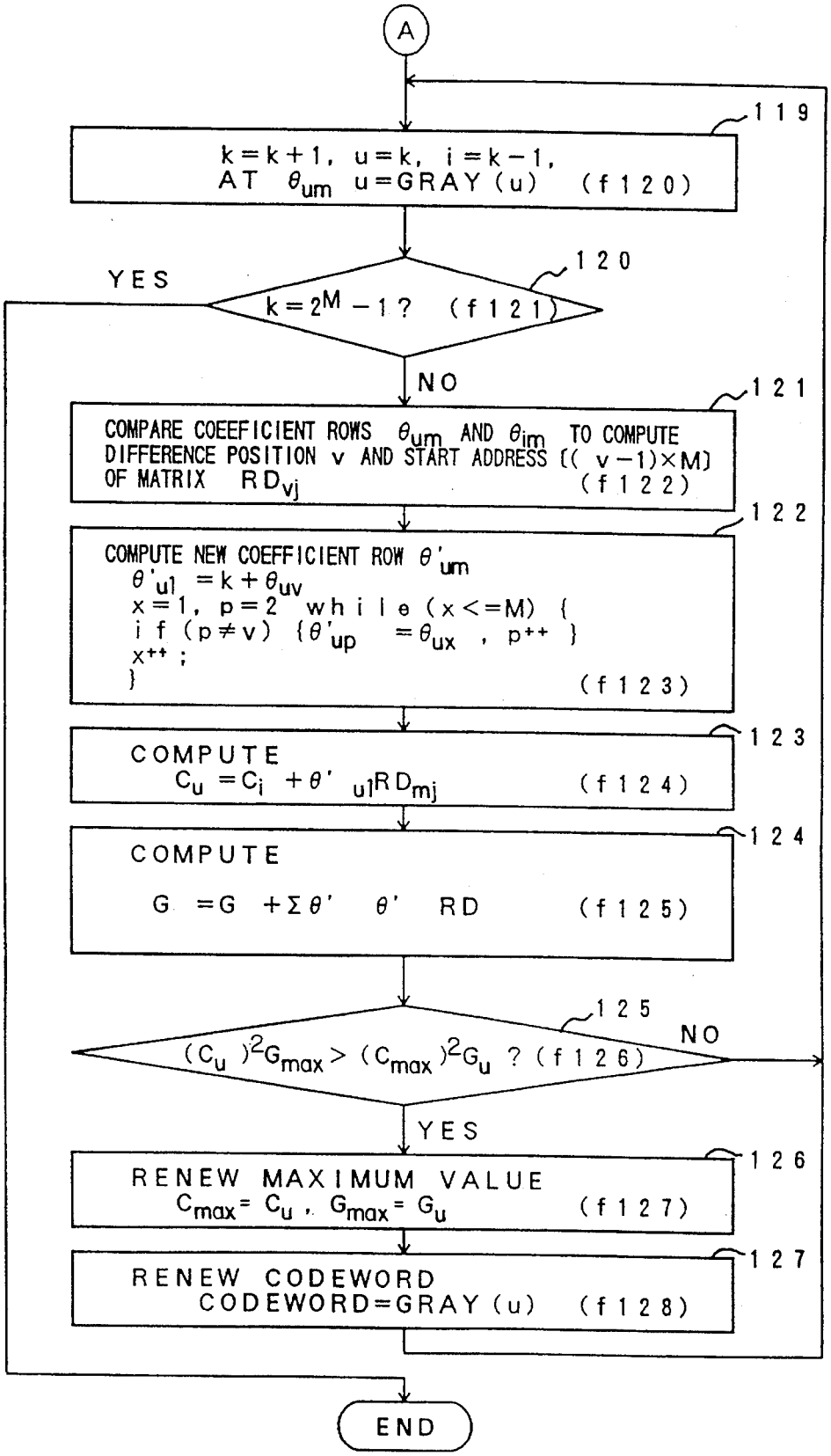

FIGS. 4A and 4B show the codebook search process in the system for search of a codebook in a speech encoder in the preferred embodiment in more detail than FIG. 3.

At step 101 in FIG. 4A, a variable k and a codeword are set to be 0, and the initial set of "i=GRAY (0)" is also done by the equation "f101".

At step 102, the first cross correlation $R_m$ ($1 \leqq m \leqq M$, M is the order of a basis vector) using signals p(n) and qm(n) is computed to obtain the ordination $R_m$ by the equation "f102".

At step 103, the second cross correlation $D_{mj}$ ($1 \leqq m \leqq j \leqq M$) using the signal qm(n) and a signal qj(n) is computed to obtain the ordination $D_{mj}$ by the equation "f103".

At step 104, the ordinations $R_m$ and $D_{mj}$ are arranged to be one ordination $RD_{mj}$. As shown at the step 104, the ordination $R_m$ is placed at the first position in each row to be followed by (M−1) of $D_{mjs}$ ($m \neq j$) in number for the first to $M^2$th positions of the ordination $R_{mj}$, and M of $D_{jjs}$ in number are placed at the $(M^2+1)$th to $M(M+1)$th positions.

At step 105, a value, at $\theta_m$, of the third cross correlation $C_u$ using $\theta_{im}$ and $R_m$, that is $C_o$ is computed by the equation "f104".

At step 106, a value, at $\theta_{om}$, of the fourth cross correlation $G_u$ comprising a cross correlation of $\theta_{im}$, $\theta_{ij}$ and $D_{mj}$ ($1 \leqq j \leqq N$, $1 \leqq m \leqq j$), that is, $G_o$ is computed by the equation "f105".

At step 107, these values are assumed to be the maximum value $C_{max}$ and $G_{max}$, respectively, and the process is continued to FIG. 4B.

At step 119 in FIG. 4B, variables k, u and i are set to be (k+1), k and k−1, respectively, and "u=GRAY (u)" is set at $\theta_{um}$ by the equation "f120". Thus, steps 121 to 127 and the step 119 are repeated by the times of $(2^M-1)$ until the equation "f121" at the step 120 becomes truth.

At the step 121, the coefficient row $\theta_{um}$ of the present time and the coefficient row $\theta_{um}$ of the former time are compared to obtain difference position v. This value v is a value of a bit to be counted from the LSB by 1, 2, . . . M, so that a start address of $RD_{vj}$ used at the steps 123 and 124 are computed by "(a start address of the ordination $RD_{mj}$)+(v−1)×M".

At the step 122, a new ordinate $\theta'_{uj}$ having $\theta_{uv}$ to be used for the calculation of $C_u$ at the step 123 and $\theta_{uj}$ ($u \neq j$) to be used for the calculation of $G_u$ at the step 124 which are arranged in the using order is obtained.

At the steps 123 and 124, $C_u$ and $G_u$ are computed by successively using $RD_{mj}$ and $\theta'_{uj}$. That is, the third cross correlation $C_u$ of the present time is effectively computed at the step 123 by adding a value determined by $\theta'_{ui}$ and $RD_{mo}$ to the third cross correlation $C_i$, as represented by the equation "f124", and the fourth cross correlation $G_u$ of the present time is effectively computed at the step 124 by adding a value determined by $\theta'_{uj}$, $\theta'_{ui}$ and $RD_{mj}$ to the formerly computed fourth cross correlation $G_i$, as represented by the equation "f125". In this preferred embodiment, four the kinds of functions are used in computing $C_u$ and $G_u$, as represented by the equations "f124" and "f125".

At the step 125, a codeword presently checked is examined as to whether it is more optimum than codewords selected so far by the equation "f126" using $C_u$ and $G_u$ presently obtained and the maximum values $C_{max}$ and $G_{max}$ among values $C_u$ and $G_u$ obtained so far. Thus, when the equation "f126" is false, that is, a codeword which is more optimum than the codeword of the present time has been already obtained, the process is returned to the step 119, and a next codeword is examined.

At step 125, when the equation "f126" is determined to be truth, that is, it is determined that the codeword of the present time is more optimum than the codewords selected so far, the steps 126 and 127 are executed, wherein the step 126 renews $C_{max}$ and $G_{max}$ with the presently computed $C_u$ and $G_u$ by the equation "f127", and the step 127 renews the codeword with the most optimum codeword in accordance with GRAY (u).

The invention is not limited to the preferred embodiment described above, and some modification or alternation may be done by those skilled in the art. For instance, the difference position V, $\theta''_{ui}$, and the new coefficient $\theta''_{uj}=\theta'_{uj}\theta'_{ui}$ may be computed in advance, and a table in which the computed results are arranged in the order of GRAY code may be prepared, so that the steps 121 and 122 are omitted, and the calculation of $\theta'_{uj}\theta'_{ui}$ carried out at the step 124 is omitted by using the new coefficient $\theta''_{uj}$.

Although the invention has been described with respect to specific embodiment for complete and clear disclosure, the appended claims are not to be thus limited but are to be construed as embodying all modification and alternative constructions that may be occur to one skilled in the art which fairly fall within the basic teaching here is set forth.

What is claimed is:

1. A machine for search of a codebook stored in a speech encoder, in which an excitation sound source is synthesized in accordance with a linear coupling of at least two predetermined basis vectors, comprising:

means for computing an ordination of a first cross correlation $R_m$ between an input speech signal p(n) and a plurality of reproduced signals gm(n) obtained by using plural basis vectors;

means for computing an ordination of a second cross correlation $D_{mj}$ of said plural reproduced signals gm(n);

means for producing one ordination $RD_{mj}$ obtained from said first and second cross correlation $R_m$ and $D_{mj}$; and means for determining a most optimum codeword by using said ordination $RD_{mj}$.

2. A machine for search of a codebook in a speech encoder, according to claim 1, wherein:

said determining means comprises means for computing combinations of third and fourth cross correlation calculations using said one ordination $R_{mj}$.

* * * * *

UNITED STATES PATENT AND TRADEMARK OFFICE

CERTIFICATE OF CORRECTION

PATENT NO. : 5,519,806

DATED : May 21, 1996

INVENTOR(S) : Makio Nakamura

It is certified that error appears in the above-indentified patent and that said Letters Patent is hereby corrected as shown below:

Column 1, line 16, delete "ill" and insert --in--.

Column 5, line 14, delete "$\Theta_{um}$" and insert --$\Theta_{im}$--.

Signed and Sealed this

Tenth Day of September, 1996

Bruce Lehman

*Attest:*

BRUCE LEHMAN

*Attesting Officer*

*Commissioner of Patents and Trademarks*